US006044875A

United States Patent [19]

Andersson et al.

[11] Patent Number: 6,044,875

[45] Date of Patent: Apr. 4, 2000

[54] DUAL CHAMBER PRODUCT TANK FOR DUAL STREAM FILLING SYSTEM

[75] Inventors: Sven-Arne Andersson, Buffalo Grove; Adam Koller, Chicago, both of Ill.

[73] Assignee: Tetra Laval Holdings & Finance, S.A., Pully, Switzerland

[21] Appl. No.: 09/070,315

[22] Filed: Apr. 30, 1998

Related U.S. Application Data

[63] Continuation-in-part of application No. 08/897,554, Jul. 21, 1997, Pat. No. 5,829,476.

[51] Int. Cl.[7] ..... B65B 1/04

[52] U.S. Cl. ..... 141/100; 141/82; 141/91; 141/105; 141/129

[58] Field of Search ..... 141/82, 85, 89, 141/91, 92, 94, 100–105, 129, 169; 53/237, 250; 220/500; 222/145.1, 145.7, 145.8

[56] References Cited

U.S. PATENT DOCUMENTS

| | | | |
|---|---|---|---|
| 2,799,432 | 4/1957 | Suppiger et al. | 141/104 |
| 3,097,764 | 7/1963 | Loeser . | |
| 3,229,477 | 1/1966 | Erickson . | |
| 3,298,383 | 1/1967 | Cooper . | |
| 3,474,965 | 10/1969 | Coleman . | |
| 3,770,208 | 11/1973 | Mueller . | |
| 3,771,322 | 11/1973 | Betschart | 141/101 |
| 4,566,251 | 1/1986 | Spisak et al. | 53/167 |
| 4,635,825 | 1/1987 | Tulasne . | |
| 4,789,100 | 12/1988 | Senf . | |
| 5,163,476 | 11/1992 | Wessman . | |
| 5,179,970 | 1/1993 | Jarocki et al. . | |
| 5,603,363 | 2/1997 | Nelson | 141/351 |
| 5,687,779 | 11/1997 | Andersson et al. . | |

*Primary Examiner*—Timothy L. Maust
*Attorney, Agent, or Firm*—Mitch Weinstein Welsh & Katz

[57] ABSTRACT

A product tank for a dual stream filling system is disclosed wherein the product tank has two chambers for containing different products that will be mixed within a carton during the filling process. The primary product in the primary chamber of the product tank may cool the secondary product in the secondary chamber. If the primary product is skim milk and the secondary product is cream, then products such as skim milk, one percent milk, two percent milk, four percent milk and cream may produced from the primary and secondary products. A filling complex is also disclosed wherein two product tanks are integrated with a filling system to fill cartons on two lines.

20 Claims, 7 Drawing Sheets

DUAL CHAMBER PRODUCT TANK FOR DUAL STREAM FILLING SYSTEM

CROSS REFERENCES TO RELATED APPLICATIONS

This application is a continuation-in-part application of U.S. patent application Ser. No. 08/897,554 filed on Jul. 21, 1997 now U.S. Pat. No. 5,829,476 which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to product tanks for form, fill and seal packaging machines. Specifically, the present invention relates to a product tank for a dual stream filling system for a packaging machine.

2. Description of the Related Art

Packages formed from a blank are usually processed on a linear form, fill and seal packaging machine. Each blank is delivered to a mandrel of the packaging machine from a carton blank opener. The blank opener is fed with a series of blanks from a magazine. The magazine holds a stack of flat blanks that are erected on the carton blank opener prior to placement on the mandrel.

Once on the mandrel, each carton has its bottom formed prior to placement on a conveyor. On the conveyor, each carton may be fitted with a fitment and sterilized prior to filling and top sealing. Novel filling techniques as disclosed in U.S. Pat. No. 5,687,779 have emerged to fulfill a need in the packaging industry, that need being the ability of a packaging machine to consecutively fill cartons with different products. This breakthrough in the packaging industry has created additional problems that must be met before the full potential of the novel filling systems is realized by dairies and other producers of flowable food products such as milk, juice, yogurt and the like.

One of the most pressing needs is the accommodation of the product tanks on the packaging machine. Also, when two or more products are mixed, one product may have a lower flow rate and thus heating of this product in the product tanks on the packaging machine may take place to the detriment of the product.

BRIEF SUMMARY OF THE INVENTION

The present invention resolves the problems of product tanks for dual stream filling by providing a product tank with dual chambers therein. The dual chamber product tank allows for space savings on the packaging machine and allows for the cooling of one product by the other product.

One aspect of the present invention is a product tank for a filling system of a packaging machine. The product tank includes a primary chamber having an exterior wall and an interior wall. The product tank also has a secondary chamber having an exterior wall and connected to the interior wall of the primary chamber. The exterior wall and the interior wall define the interior of the secondary chamber. The product tank also has a primary product inlet in flow communication with the primary chamber, and a secondary product inlet in flow communication with the secondary chamber. The product tank also has a primary fill pipe outlet in flow communication with the primary chamber and a primary fill pipe, and a secondary fill pipe outlet in flow communication with the secondary chamber and a secondary fill pipe.

Another aspect of the present invention is a filling system having a product tank with dual chambers and primary and secondary fill pipes. Yet another aspect of the present invention is a packaging machine having a filling complex with tow filling systems. Each of the filling systems have a product tank with dual chambers and primary and secondary fill pipes.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a isolated perspective view of a filling system of the present invention for a dual line packaging machine, the filling system having two dual chamber product tanks;

Figure 2:
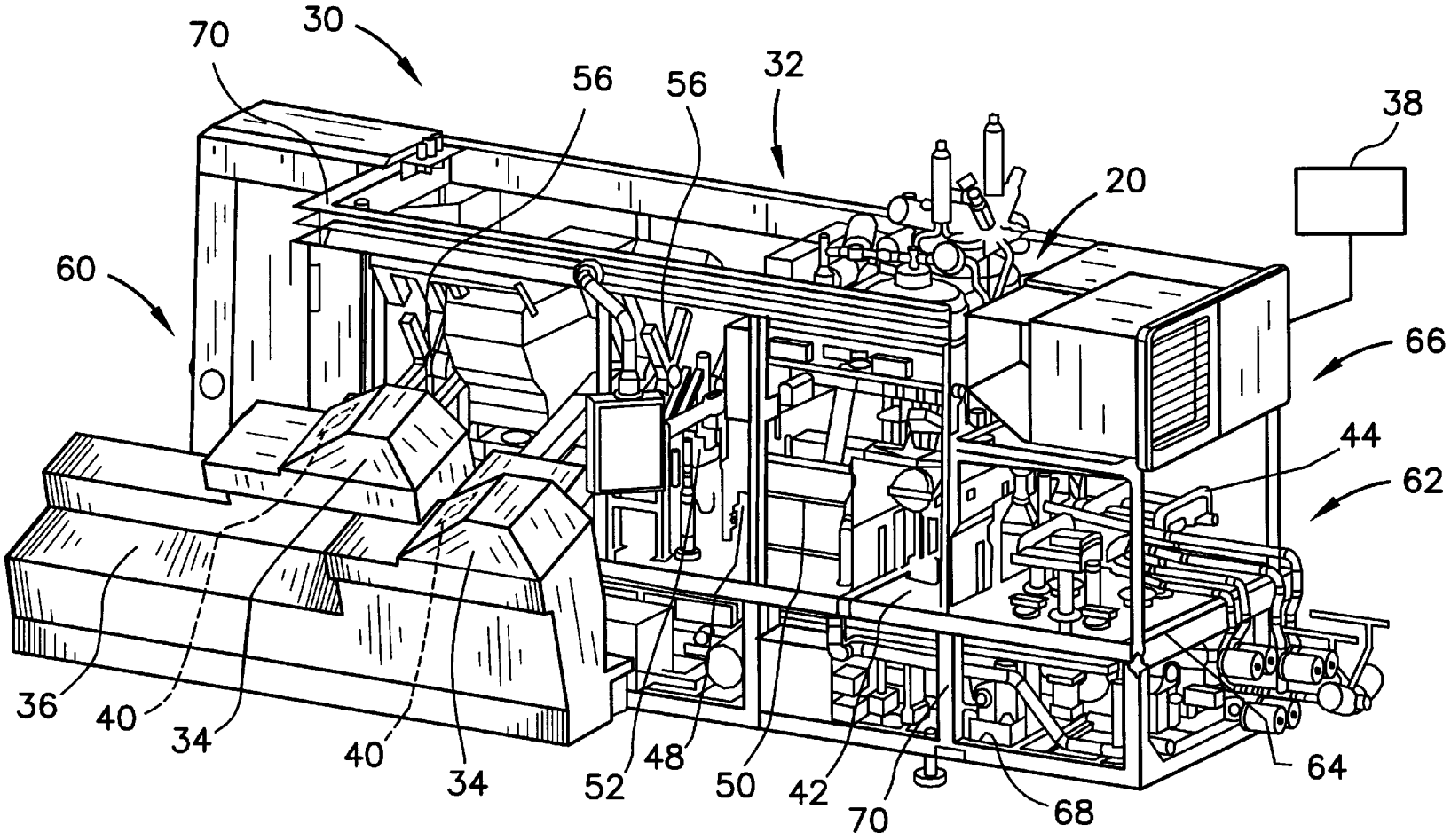
Figure 3:
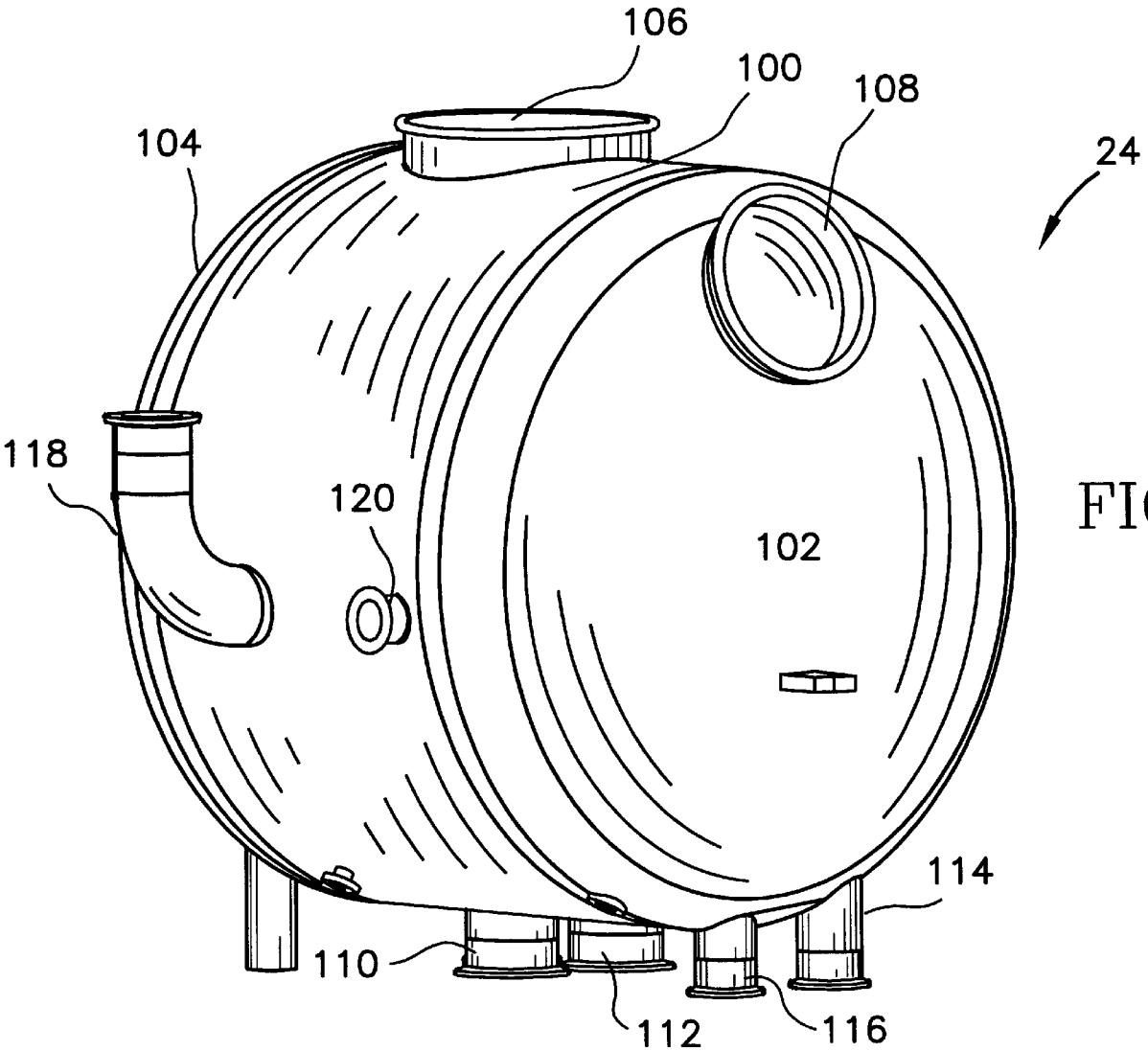
Figure 4:
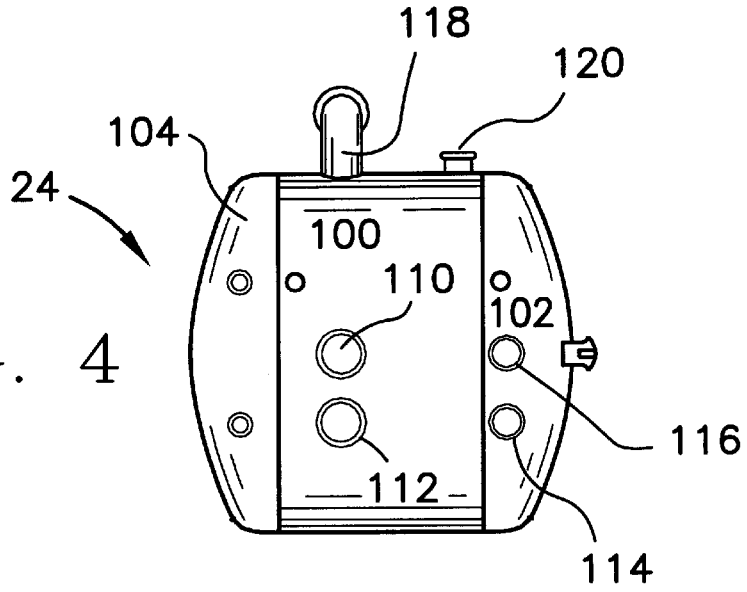
Figure 6:
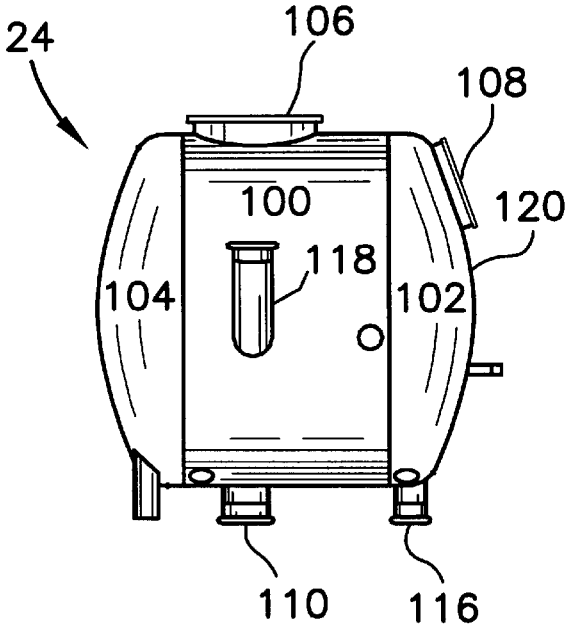
Figure 5:
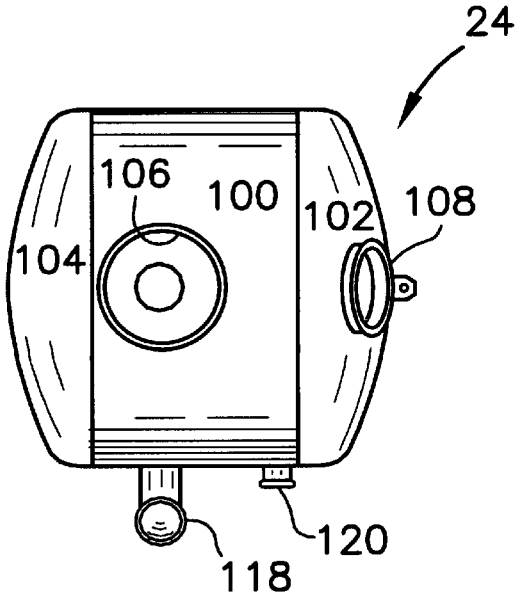
Figure 7:
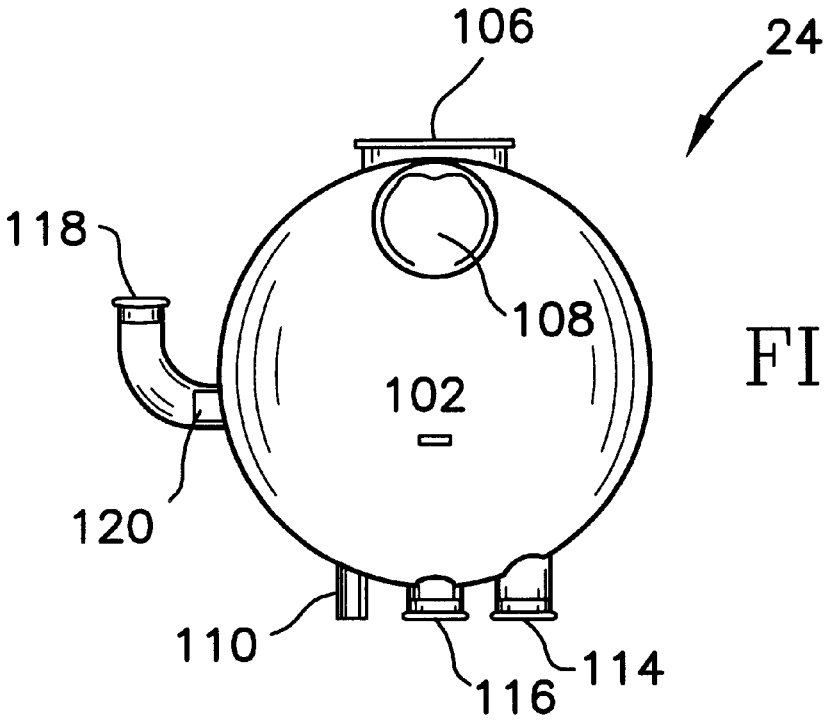
Figure 8:
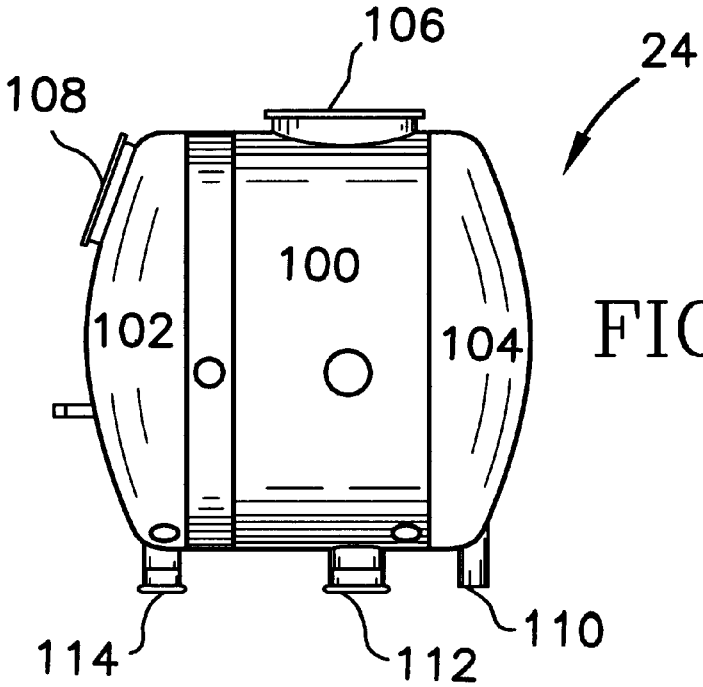
Figure 9:
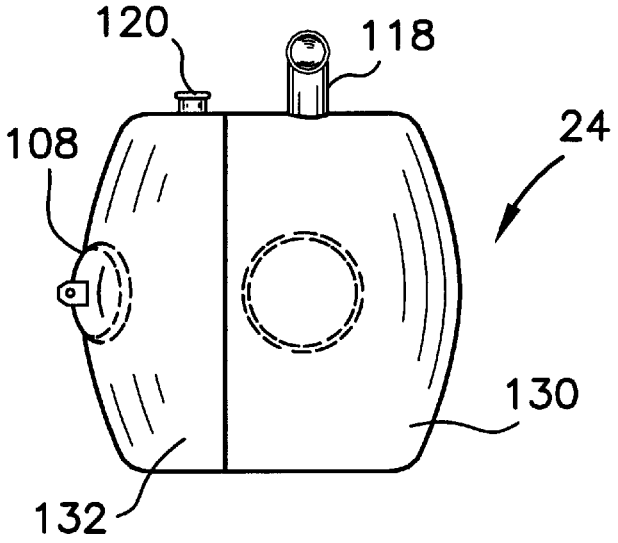
Figure 10:
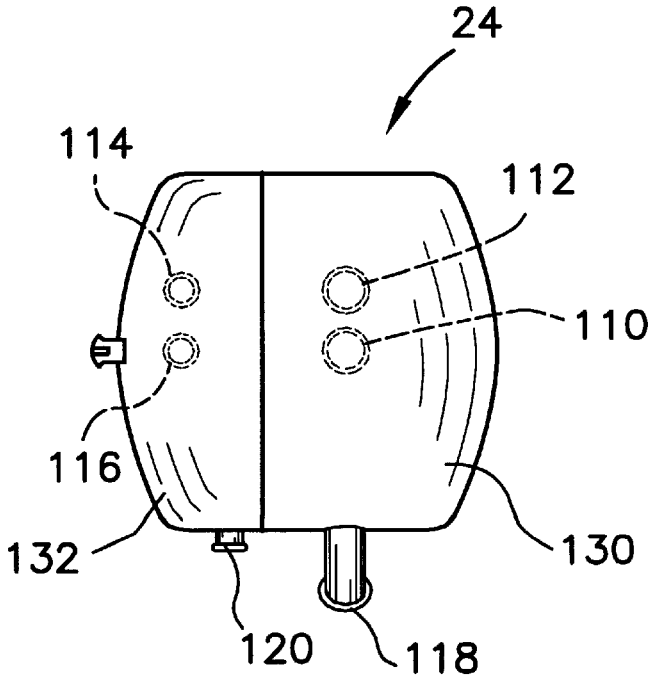
Figure 11:
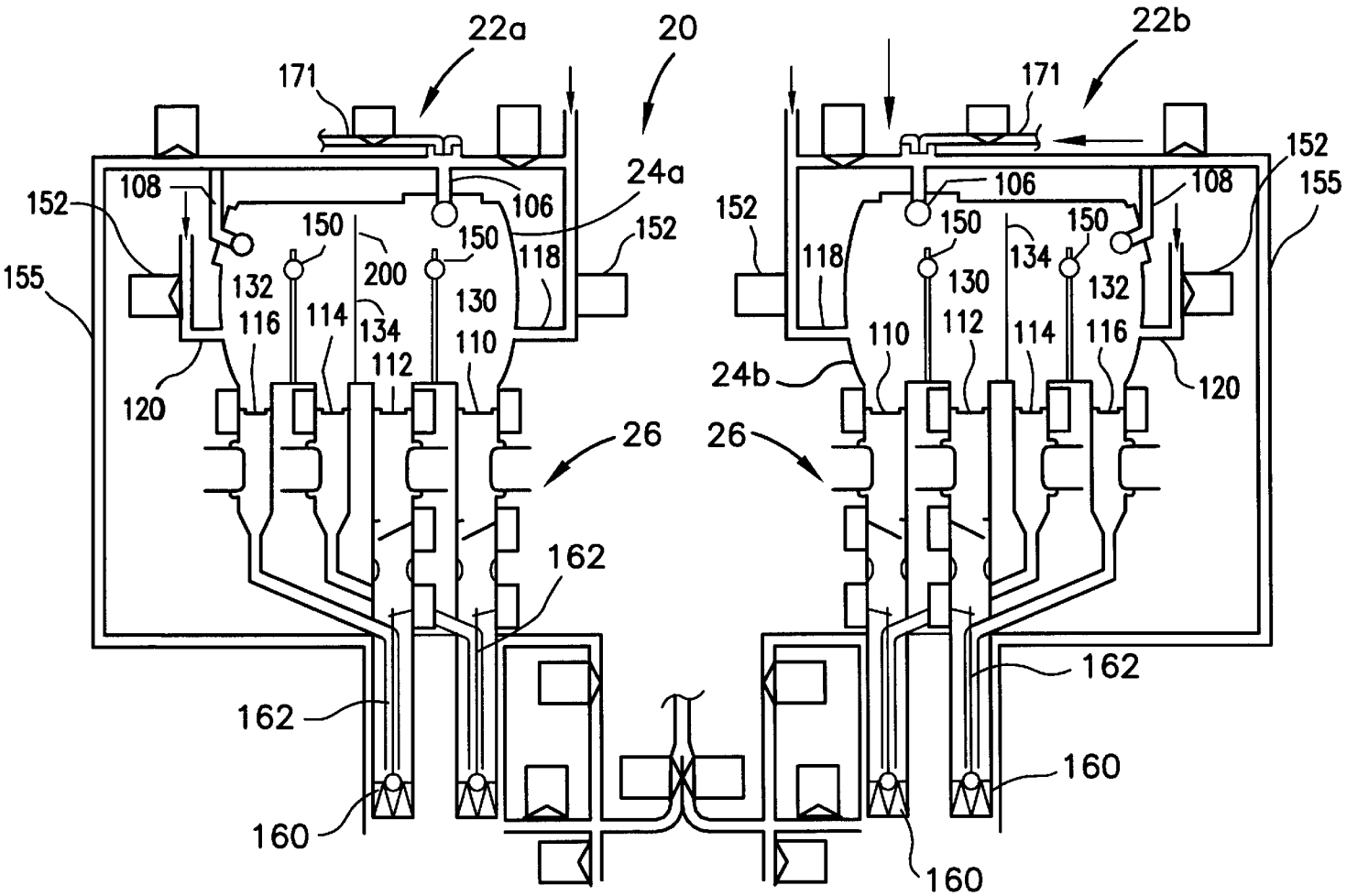

There is illustrated in FIG. 2 a top perspective view of a packaging machine having a filling system of the present invention;

There is illustrated in FIG. 3 an isolated perspective view of a dual chamber product tank of the present invention;

There is illustrated in FIG. 4 a bottom plan view of the product tank of FIG. 3;

There is illustrated in FIG. 5 a top plan view of the product tank of FIG. 3;

There is illustrated in FIG. 6 a left side view of the product tank of FIG. 3;

There is illustrated in FIG. 7 a front view of the product tank of FIG. 3;

There is illustrated in FIG. 8 a right side view of the product tank of FIG. 3;

There is illustrated in FIG. 9 a cross-sectional view of the interior of the product tank of FIG. 3 along line 9—9 of FIG. 6;

There is illustrated in FIG. 10 a cross-sectional view of the interior of the product tank of FIG. 3 along line 10—10 of FIG. 6;

There is illustrated in FIG. 11 a schematic diagram of the filling complex of the present invention.

DETAILED DESCRIPTION OF THE INVENTION

Figure 1:
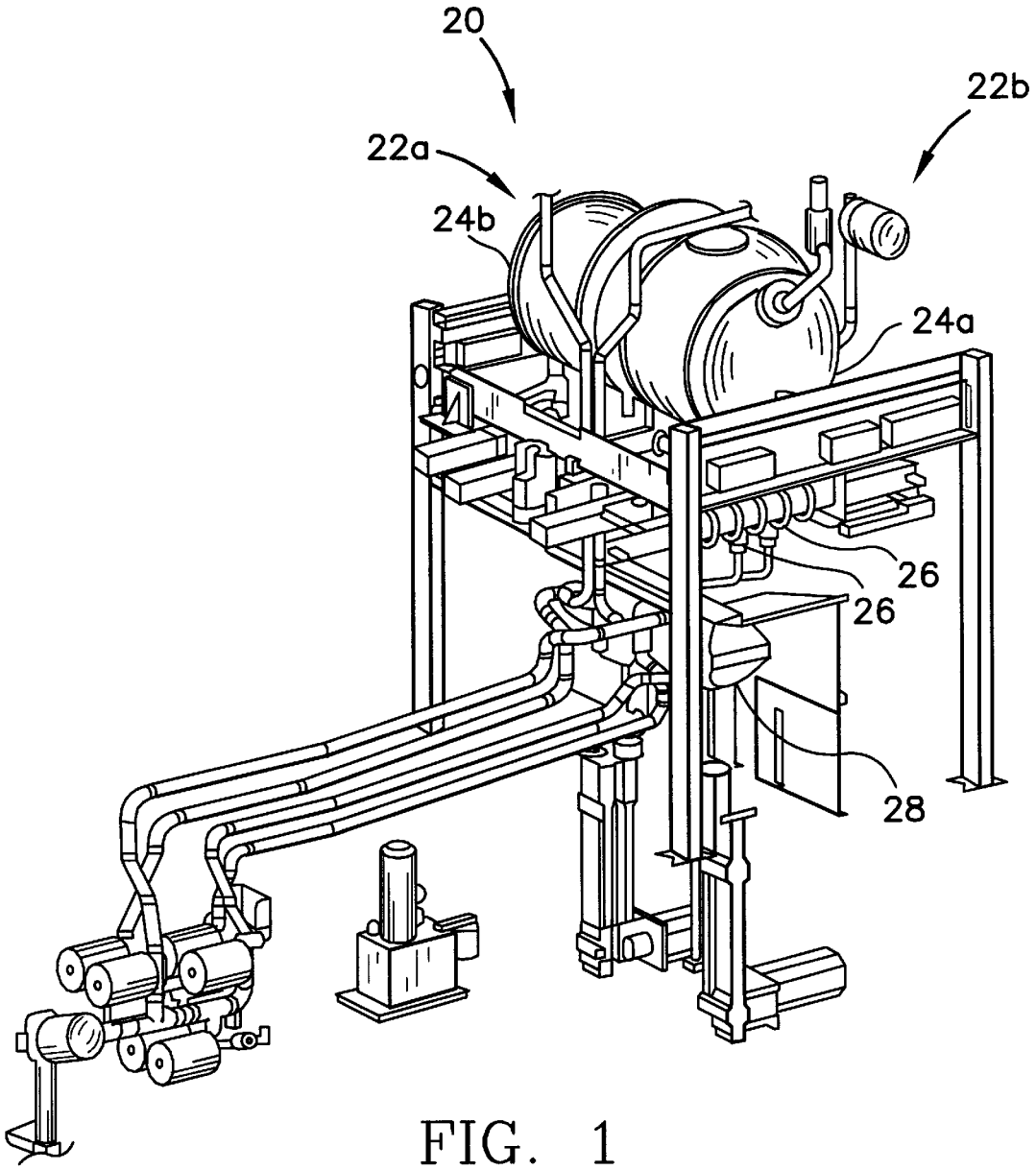

An isolated view of a filling complex 20 is shown in FIG. 1. The filling complex is for a dual line packaging machine wherein two lines of cartons are processed to create formed, filled and sealed cartons with a desired product. The filling complex has two filling systems 22*a–b* positioned adjacent each other on a packaging machine. The most prominent aspect of the two filling systems is the dual chamber product tanks 24*a–b*. The product tanks 24*a–b* are disposed above the conveyor lines and near the top of the packaging machine. A plurality of pumps are disposed beneath the tanks 26*a–b* and further down the flow of product from the tanks 26*a–b* to the cartons are a pair of cleaning boxes 28. The cleaning boxes 28 encompass a plurality of fill pipes, not shown in FIG. 1, that will be described below.

There is illustrated in FIG. 2 a packaging system generally designated 30. The packaging system 30 includes a packaging machine 32, a carton opener 34, and a magazine 36. The packaging machine may be a typical linear form, fill and seal packaging machine such as a TETRA REX® packaging machine available from Tetra Pak, Incorporated of Chicago, Ill. The packaging machine 32 may have a programmable logic controller ("PLC") 38 to control the various operations of the packaging system 30. Also, disposed within the packaging system 30 there may be a bar code reader 40 which communicates via the PLC 38 the size and filling requirements of each carton to the necessary components of the packaging machine 32, such as the filling complex 20. A bar code reader for a packaging machine is disclosed in co-pending U.S. patent application Ser. No. 09/063,763 filed on Apr. 21, 1998 and entitled Multi-Product Packaging Machine With Bar Code Reader which is hereby incorporated by reference.

The packaging machine 32 for forming, filling and sealing cartons generally includes a high hygiene zone 42 which is composed of a top sealing station 44 and the filling complex 20, a sterilization station 48 which is composed of an ultraviolet radiation station 50 and a hydrogen peroxide station 52, an optional fitment applicator station, and a bottom forming station 56. From an operational perspective, the front 60 of the packaging machine 32 is where the processing begins, and the rear 62 is where the finished cartons are dispensed for distribution.

The packaging machine 32 may be divided along a horizontal plane defined by a table top 64. The table top 64 divides the packaging machine 32 into an upper half 66 and a lower half 68. A frame 70 defines the general structure of the packaging machine 32 and supports the table top 64 and the various stations. The lower half 68 of the machine 32 includes servomotors, drive cylinders, cam drives and other components. The upper half 66 includes the various stations, the product tanks 24*a–b*, the conveyor system, and other components to process cartons.

As shown in FIGS. 3–10, the product tank 24 has a generally cylindrical center section 100, a front section 102 and a rear section 104. There is disposed on the top of the center section 100 a primary tank ventilation outlet 106. A secondary tank ventilation outlet 108 is disposed on the front section 102. On the bottom of the center section 100 are the first and second primary product outlets 110, 112, and on the bottom of the front section 102 are the first and second secondary product outlets 114, 116. At a mid-point of the center body there is disposed a primary product inlet 118 for introducing a primary product into a primary chamber 130, and a secondary product inlet 120 for introducing a secondary product into a secondary chamber 132.

As shown in FIGS. 9–10, the primary chamber 130 is partitioned from the secondary chamber 132 by an internal wall 134. Preferably, the product tank 24, including all of its components, is composed of stainless steel.

As shown in FIG. 11, each of the chambers 130, 132 has a level probe 150 disposed therein. The level probe measures the level of the product in a chamber and thereby controls the flow of product through a product valve 152. Air in the chambers 130, 132 is ventilated through outlets 106, 108 through tubing 155 to the area about the plurality primary fill pipes 160 (and the cleaning box 28) in order to maintain like sterile air through the filling complex 20. The sterile air is supplied from a sterile air supply, not shown. Cleaning fluid, supplied from a cleaning fluid supply 171, may also be introduced to the chambers 130 and 132 through outlets 106 and 108.

In this embodiment, each of the plurality of primary fill pipes 160 has a secondary fill pipe 162 concentrically disposed therein. Such as arrangement is described in more detail in co-pending U.S. patent application Ser. No. 08/897,554. An alternative arrangement is described in U.S. Pat. No. 5,687,779 which is hereby incorporated by reference. Additionally, those skilled in the art will recognize that the secondary fill pipes 162 may be outside of the primary fill pipes 160 without departing from the scope and spirit of the present invention.

In operation, the primary chamber 130 is partially filled with a primary product such as skim milk. The secondary chamber 132 is partially filled with a secondary product such as cream. Sterile air is introduced through outlets 106 and 108 to fill the 15 chambers 130 and 132. As the product level changes, the sterile air is ventilated through the outlets 106 and 108 through tubing 155 and to the area about the fill pipes 160. The internal wall 134 maintains the separation of products, however, the internal wall 134 does allow for a transfer of heat from one chamber to another chamber. For example, if the secondary product is cream, the secondary chamber 132 is cooled by the primary chamber 130 which may contain skim milk. The flow of the primary product is usually greater than that of the secondary product allowing for cooler product from a main supply tank to cool the primary chamber 130. The lowered flow of the secondary product allows for an accumulation of heat in the secondary chamber 132. The sharing of the internal wall 134 between chambers 130 and 132 allows for the transfer of heat thereby equalizing the temperatures of the chambers 130 and 132.

Optionally, as shown for fill system 22*a* of FIG. 11, the internal wall 134 may have an aperture 200 therethrough. The aperture 200 allows for equalization of the pressure between chambers 130 and 132 since the internal wall 134 may not be structurally adequate to withstand high pressure differentials between the chambers 130 and 132. For example, during steam cleaning of the chambers 130 and 132, if the pressure in one chamber was to increase far beyond that of the other chamber, then the internal wall 134 may be damaged or completely destroyed. The aperture 200 would allow for the transfer of steam between chambers 130 and 132 to equalize the pressure within both chambers 130 and 132 during a steam cleaning cycle.

Returning to the filling operation, as cartons are conveyed below each primary fill pipe 160, the PLC will instruct the filling system 22 to fill the carton with a set amount of each of the primary and secondary products to produce a desired product. For example, if two percent milk is desired, a small amount of cream will be dispensed into the carton followed, or concurrently with, a large amount of skim milk to produce the two percent product. Those skilled in the art will recognize that other combinations of products are within the scope and spirit of the present invention.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. A filling system for a packaging machine, the packaging machine having a series of cartons conveyed along a predetermined path, the filling system comprising:

a product tank having a primary chamber for storing a primary fluid and a secondary chamber for storing a secondary fluid;

a plurality of primary fill pipes in flow communication with the primary chamber on one end and having a dispensing end for dispensing a primary product into a carton; and a plurality of secondary fill pipes in flow communication with the secondary chamber on one end and having a dispensing end for dispensing a secondary product into a carton, wherein one of the primary fluid in the primary chamber and the secondary fluid in the secondary chamber cools the other of the primary and secondary fluid in its respective chamber.

2. The filling system according to claim 1 wherein each of the plurality of secondary fill pipes is concentrically disposed within a corresponding primary fill pipe.

3. The filling system according to claim 1 wherein the primary chamber and the secondary chamber each have a level probe disposed therein.

4. The filling system according to claim 1 wherein the primary chamber and the secondary chamber each have a cleaning fluid inlet for introduction of a cleaning fluid into each of the chambers during a cleaning cycle.

5. The filling system according to claim 1 wherein the primary product in the primary tank cools the secondary product in the secondary tank.

6. The filling system according to claim 1 wherein the primary chamber and the secondary chamber share an internal wall.

7. A product tank for a filling system of a packaging machine, the filling system having primary and secondary fill pipes in flow communication with a series of containers conveyed along a container path, the product tank system comprising:

a primary chamber for storing a primary product, the primary chamber having an exterior wall and an interior wall;

a secondary chamber for storing a secondary product, the secondary chamber having an exterior wall and connected to the interior wall of the primary chamber, the exterior wall and the interior wall defining the interior of the secondary chamber;

a primary product inlet in flow communication with the primary chamber;

a secondary product inlet in flow communication with the secondary chamber;

a primary fill pipe outlet in flow communication with the primary chamber and the primary fill pipe; and a secondary fill pipe in flow communication with the secondary chamber and the secondary fill pipes, wherein one of the primary product in the primary chamber and the secondary product in the secondary chamber cools the other of the primary product and the secondary product in its respective chamber.

8. The product tank according to claim 7 wherein the secondary fill pipe is concentrically disposed within the primary fill pipe.

9. The product tank according to claim 7 wherein the primary chamber and the secondary chamber each have a level probe disposed therein.

10. The product tank according to claim 7 wherein the primary chamber and the secondary chamber each have a cleaning fluid inlet for introduction of a cleaning fluid into each of the chambers during a cleaning cycle.

11. The product tank according to claim 7 wherein the primary product in the primary tank cools the secondary product in the secondary tank.

12. The product tank according to claim 7 wherein the internal wall has an aperture therethrough for equalization of the pressure between the primary chamber and the secondary chamber.

13. The product tank according to claim 7 wherein the primary chamber and the secondary chamber each have a ventilation outlet for venting air out of the chambers.

14. A packaging machine for forming, filling and sealing a series of cartons being processed thereon, the packaging machine conveying the series of cartons along two predetermine d paths, the packaging machine comprising:

a bottom forming station;

a sterilization station;

a filling complex disposed above the two predetermined paths, the filling complex having a filling system for each predetermine path, each filling system having a product tank with primary and secondary chambers for storing primary and secondary products, respectively, the filling complex including a plurality of primary fill pipes in flow communication with the primary chamber and a plurality of secondary fill pipes in flow communication with the secondary chamber; and a sealing station for sealing the cartons after filling at the filling complex, wherein one of the primary product in the primary chamber and the secondary product in the secondary chamber cools the other of the primary product and the secondary product in its respective chamber.

15. The packaging machine according to claim 14 wherein each of the plurality of secondary fill pipes is concentrically disposed within a corresponding primary fill pipe.

16. The packaging machine according to claim 14 wherein the primary chamber and the secondary chamber each have a level probe disposed therein.

17. The packaging machine according to claim 14 wherein the primary chamber and the secondary chamber each have a cleaning fluid inlet for introduction of a cleaning fluid into each of the chambers during a cleaning cycle.

18. The packaging machine according to claim 14 wherein the primary product in the primary tank cools the secondary product in the secondary tank.

19. The packaging machine according to claim 14 wherein the primary chamber and the secondary chamber share an internal wall.

20. The packaging machine according to claim 14 wherein a PLC controls the flow of product from each of the primary and secondary chambers into the fill pipes.

* * * * *